US008987185B2

(12) United States Patent
Hutmacher et al.

(10) Patent No.: US 8,987,185 B2
(45) **Date of Patent: *Mar. 24, 2015**

(54) LAUNDRY ARTICLE HAVING CLEANING AND CONDITIONING PROPERTIES

(75) Inventors: Martina Hutmacher, Düsseldorf (DE); Wolfgang von Rybinski, Düsseldorf (DE); Inga Kerstin Vockenroth, Düsseldorf (DE); Georg Meine, Mettmann (DE); Katherine Yu, Phoenix, AZ (US); Matthew Michael Petkus, Scottsdale, AZ (US); Bin Lin, Scottsdale, AZ (US)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/156,671

(22) Filed: Jun. 9, 2011

(65) Prior Publication Data

US 2011/0265272 A1 Nov. 3, 2011

Related U.S. Application Data

(63) Continuation of application No. PCT/EP2009/066321, filed on Dec. 3, 2009.

(60) Provisional application No. 61/122,088, filed on Dec. 12, 2008.

(51) Int. Cl.

| | |
|---|---|
| ***C11D 17/00*** | (2006.01) |
| ***C11D 17/04*** | (2006.01) |
| ***C11D 1/62*** | (2006.01) |
| ***C11D 3/00*** | (2006.01) |
| ***C11D 3/20*** | (2006.01) |

(52) U.S. Cl.

CPC ..... *C11D 17/047* (2013.01); *C11D 1/62* (2013.01); *C11D 3/001* (2013.01); *C11D 3/2079* (2013.01); *C11D 3/2093* (2013.01); *C11D 17/041* (2013.01)

USPC ..... 510/438; 510/439; 510/424; 510/428; 8/137

(58) Field of Classification Search

USPC ..... 8/137; 510/438, 439, 424, 428

See application file for complete search history.

(56) References Cited

U.S. PATENT DOCUMENTS

| | | | | | |
|---|---|---|---|---|---|
| 3,704,228 | A | * | 11/1972 | Eckert et al. | 510/322 |
| 4,000,340 | A | * | 12/1976 | Murphy et al. | 428/34.1 |
| 4,022,938 | A | * | 5/1977 | Zaki et al. | 427/242 |
| 4,095,946 | A | | 6/1978 | Jones et al. | |
| 4,170,565 | A | | 10/1979 | Flesher et al. | |
| 6,133,226 | A | | 10/2000 | Knowlton et al. | |
| 2003/0069164 | A1 | | 4/2003 | Levinson | |

FOREIGN PATENT DOCUMENTS

| | | | |
|---|---|---|---|
| GB | 2260997 | A | 5/1993 |
| WO | WO 2007/120867 | A2 | 10/2007 |

OTHER PUBLICATIONS

PCT International Search Report (PCT/EP2009/066321) dated Feb. 19, 2010.

* cited by examiner

*Primary Examiner* — Joseph L Perrin

(74) *Attorney, Agent, or Firm* — Thomas G. Krivulka

(57) ABSTRACT

The invention discloses a laundry article used for both cleaning and conditioning fabrics comprising a water-insoluble nonwoven substrate and coated thereon into at least one zone each a detergent composition and a fabric conditioning composition. The fabric conditioning composition comprises a quaternary ammonium cationic surfactant, an alkoxylated fatty alcohol and a fatty acid.

7 Claims, No Drawings

LAUNDRY ARTICLE HAVING CLEANING AND CONDITIONING PROPERTIES

CROSS-REFERENCES TO RELATED APPLICATIONS

This is a continuation of International Application No. PCT/EP2009/066321, filed Dec. 3, 2009, which claims priority to U.S. Provisional Application No. 61/122,088 filed Dec. 12, 2008, both of which are hereby incorporated by reference.

FIELD OF THE INVENTION

The present invention generally relates to an article of manufacture used for both cleaning and conditioning fabrics and more particularly relates to an article comprising a water-insoluble substrate coated with detergent, fabric conditioning, and optionally other fabric treatment compositions, which functions as a single product for washing and conditioning fabrics when added to the washing machine and then carried along with the wet clothes into the clothes dryer. The invention also relates to a method of manufacturing and to a method of using such articles.

BACKGROUND OF THE INVENTION

State of the art powdered, solid, liquid and unitized dose (tablet, pouch and sheet) detergents continue to face additional problems. Most problematic is that fragrance delivery to the fabrics through the wash is limited. The only practical method to obtain heavily scented clothing is to use several heavily scented dryer sheets in the clothes dryer at one time. Detergents that deliver fragrance to the wash liquor do not deliver fragrance that is substantive enough to make it through the rinse water and onto the wet fabrics transferred into the clothes dryer. A significant portion of the fragrance contained in the detergent does not adsorb onto the fabrics and instead is drained away and wasted in the washing machine.

Consequently, in order to achieve high fragrance retention on the fabrics, a second product is added during either the rinse cycle of the washing process (a heavily scented liquid fabric softener for example), or more preferred, added directly to the dryer in the form of a fabric softener sheet (a dryer sheet).

A second limitation of these conventional detergent and conditioning products is that it is difficult for a detergent to deliver either an anti-static benefit or a softening benefit due to the incompatibility of the quaternary ammonium compounds, the chemical required for either of these benefits, and the anionic surfactants that are required in detergent compositions for good cleaning. While a number of recent new product introductions have claimed to deliver "2-in-1" detergent benefits (cleaning+anti-stat/softening), the level of conditioning performance achieved by these products has been so very low so as to not be well perceivable by the consumer.

WO 0711 20867 A2 provides a laundry article that overcomes the above mentioned drawbacks and that comprises a water-insoluble substrate coated with detergent, fabric conditioning, and optionally other fabric treatment compositions, which functions as a single product for washing and conditioning fabrics when added to the washing machine and then carried along with the wet clothes into the clothes dryer. The laundry article comprises a water-insoluble substrate onto which a minimum of two compositions is applied in "zones".

The fabric conditioning composition applied to the substrate includes a quaternary ammonium cationic surfactant, such as traditional tetraalkyl materials or ester quaternaries. These materials are waxy solids or are highly viscous at ambient temperature such that the material can be melted and applied hot to the substrate.

For this kind of laundry article it is highly desirable to provide the fabric conditioning composition on a relatively small portion of the substrate. Consequently, a composition containing a high amount of ammonium cationic surfactants needs to be applied on the substrate.

One disadvantage of such highly concentrated solid fabric conditioning compositions is their firmness. Hence, during the washing process it may occur that the zone containing the quaternary ammonium cationic surfactants is broken into smaller pieces due to the firmness. On the one hand, some of these pieces are subsequently released from the surface of the substrate and are carried away by the washing liquor. On the other hand, pieces that still remain on the surface of substrate during the washing process may be transferred en bloc to the cloths in the subsequent drying process in the clothes dryer and then lead to spotting.

Therefore in spite of the prior art developments, there is still a need for a laundry article comprising a water-insoluble substrate coated with a detergent composition and a fabric conditioning composition that shows no or only very little spotting.

SUMMARY OF THE INVENTION

The needs highlighted by the prior art are addressed by the laundry article of the present invention, used for both cleaning and conditioning fabrics, comprising:

a. a water-insoluble nonwoven substrate;
b. a detergent composition solidified on the substrate in at least one zone; and,
c. a fabric conditioning composition solidified on the substrate in at least one zone, wherein the fabric conditioning composition comprises a quaternary ammonium cationic surfactant and an additive selected form the group consisting of trialkyl glycerides, fatty acids and mixtures thereof.

Other desirable features and characteristics of the present invention will become apparent from the subsequent detailed description of the invention and the appended claims, taken in conjunction with the background of the invention.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

It has surprisingly been found that the use of a combination of a quaternary ammonium cationic surfactant with a trialkyl glyceride and/or a fatty acid in the fabric conditioning composition of such a laundry article leads to a laundry article with good cleaning properties as well as conditioning properties and that shows no or only very little spotting on the cloths treated therewith. The trialkyl glyceride and/or the fatty acid serve to adjust the melting point and/or the firmness of the fabric conditioning composition. If the latter is reduced, the likeliness that the fabric conditioning composition zone is broken up into smaller pieces during the washing cycle is also reduced. Additionally, it has been surprisingly found that the laundry article of the present invention exhibits improved performance with respect to fragrance delivery, if present.

In a preferred embodiment of the invention the laundry article according to the present invention contains the quaternary ammonium cationic surfactant at a level from 55% by weight to 90% by weight of the fabric conditioning composition and more preferred from 60% by weight to 80% by weight of the fabric conditioning composition.

These amounts of quaternary ammonium cationic surfactant show a successful degree of fabric conditioning property.

Furthermore, it is preferred that the additive is at a level from 10% by weight to 45% by weight of the fabric conditioning composition and more preferred from 10% by weight to 40% by weight of the fabric conditioning composition.

The additive serves to adjust the melting point and/or the firmness of the fabric conditioning composition. It has become evident that it is advantageous to adjust the melting point of the fabric conditioning composition in a range between 50 to 58° C. in order to avoid spotting. Although a dryer is usually operated at temperatures between 60 to 100° C., during the drying process the temperature at the surface of the fabrics is in the range of 40 to 50° C. due to the evaporation of water being present in the cloths. If the melting point of fabric conditioning composition is too low, that is considerably lower than 50° C., the fabric conditioning composition will melt immediately after the dryer starts raising the temperature inside the drum and it will be transferred spot-wise to the cloths/fabrics. If the melting point of the fabric conditioning composition is too high no or only little amounts will be transferred to the cloths/fabrics inside the drum.

In another particularly preferred embodiment of the invention the laundry article according to the present invention the additive comprises a mixture of trialkyl glycerides and fatty acids.

A laundry article according to the present invention comprising a fabric conditioning composition comprising a combination of these two additives shows no or only very little spotting. Additionally, the fatty acid has proven to not only adjust the melting point and/or the firmness of the fabric conditioning composition but also to improve the fragrance delivery to cloths, if present. Without wishing bound to theory, it is assumed that the fatty acid is first converted into the corresponding soap during the washing process and subsequently removed from the fabric conditioning composition. As a consequence, after the washing stage the fabric conditioning composition zone possesses a porous structure that facilitates the delivery of the fragrance to the cloths during the drying stage.

It is preferred that in the fabric conditioning composition comprises trialkyl glyceride and/or fatty acid at a level from 10% by weight to 45% by weight of the fabric conditioning composition and more preferred from 10% by weight to 40% by weight of the fabric conditioning composition.

These amounts of trialkyl glycerides and/or fatty acid give optimum results for the adjustment of the melting point and/or the firmness and/or spotting of the fabric conditioning composition.

In a yet another preferred embodiment of the invention the fabric conditioning composition additionally comprises a fragrance.

A fragrance is preferably added to the fabric conditioning composition zone of the present invention in order to gain consumer acceptance, to cause product recognition and recall, and most importantly to impart substantive fragrance to the fabrics inside the clothes dryer.

It is preferred that the trialkyl glyceride is selected from saturated or unsaturated $C_5$-$C_{22}$-alkyl triglycerides. These trialkyl glycerides are common and commercially available.

Additionally, it is preferred that the fatty acid is selected from caprylic acid, capric acid, lauric acid, myristic acid, palmitic acid, stearic acid, (hydrogenated) erucaic acid, linoleic acid, linolenic acid, oleic acid, (hydrogenated) behenic acid, coconut fatty acid, palm kernel fatty acid, olive oil fatty acid, and tallow fatty acid. These fatty acids have already been used in the laundry industry for a long time.

The present invention also relates to a method of producing a laundry article used for both cleaning and conditioning fabrics comprising a water-insoluble nonwoven substrate, a detergent composition and a fabric conditioning composition comprising the steps of:

a. melting a detergent composition;
b. melting a fabric conditioning composition comprising a quaternary ammonium cationic surfactant and an additive selected form the group consisting of trialkyl glycerides, fatty acids and mixtures thereof:
c. supplying a length of nonwoven substrate; and,
d. coating said substrate with both the molten detergent composition and the molten fabric conditioning composition into at least one zone each and allowing the resulting detergent and fabric conditioning composition zones to cool and solidify on the substrate.

Additionally, the invention relates to a method of washing and conditioning fabrics comprising the steps of:

a. supplying the laundry article according to the present invention;
b. washing a load of fabrics in a laundry machine with said article;
c. removing the washed fabrics from said laundry machine along with said article;
d. transferring the fabrics into the dryer along with said article; and,
e. drying said fabrics in the dryer along with said article.

The invention is described in greater detail below on the basis of examples, among other things.

In general, the present invention is a laundry article comprising a water-insoluble substrate onto which a minimum of two compositions is applied in "zones". The laundry article of the present invention comprises water-insoluble substrate with one zone of detergent composition, plus one zone of fabric conditioning composition, arranged in geographical areas, or patterns or regions, (called "zones"), on the water-insoluble substrate. Optional perforations on the article allow the consumer to break apart the article along defined lines to customize the product for the specific laundering requirements, customizing the amounts and the formulas used for a particular laundry load.

It is essential for the present invention that the fabric conditioning composition comprises a quaternary ammonium cationic surfactant and an additive selected form the group consisting of trialkyl glycerides, fatty acids and mixtures thereof.

A variety of quaternary ammonium cationic surfactant may be utilized; however acyclic quaternary surfactants are preferred. For example, useful quaternary synthetic surfactants that are acyclic include linear alkyl, branched alkyl, hydroxyalkyl, oleylalkyl, acyloxyalkyl, diamidoamine, or diester quaternary ammonium compounds. The preferred quaternary surfactants for use in the present invention are waxy solids at ambient temperature such that the material can be melted and applied hot to the substrate, and these may include traditional tetraalkyl materials or ester quaternaries, or combinations of the two types.

Cyclic quaternary materials such as the imidazolines may be used but are less preferred in the present invention.

The quaternary ammonium cationic surfactant in accordance with a preferred embodiment is at a level from 55% by weight to 90% by weight of the fabric conditioning composition and more preferred from 60% by weight to 80% by weight of the fabric conditioning composition. Examples of acyclic quaternary ammonium cationic surfactants useful in the present invention are shown by the general formulae (I) and (II):

(I)

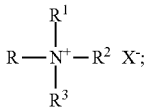

(II)

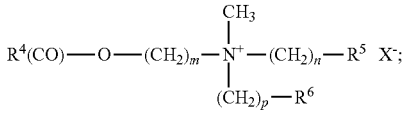

wherein the general formula (I), R and $R^1$ are individually selected from the group consisting of $C_1$-$C_4$ alkyl, benzyl, and —$(C_2H_4O)_xZ$ where x has a value from 1 to 20 and Z is hydrogen or $C_1$-$C_3$ alkyl; $R^2$ and $R^3$ are each a $C_8$-$C_{30}$ alkyl or $R^2$ is a $C_8$-$C_{30}$ alkyl and $R^3$ is selected from the group consisting of $C_1$-$C_5$ alkyl, benzyl, and —$(C_2H_4O)_x$—H where x has a value from 2 to 5; and where $X^-$ represents an anion selected from the group consisting of halides, methyl sulfate, ethyl sulfate, methyl phosphate, acetate, nitrate or phosphate ion and mixtures thereof. Specific examples of quaternary surfactants described within the general formula (I) include alkyltrimethylammonium compounds, dialkyldimethylammonium compounds and trialkylmethylammonium compounds including but not limited to, tallow trimethyl ammonium chloride, ditallow dimethyl ammonium chloride, ditallow dimethyl ammonium methyl sulfate, dihexadecyl dimethyl ammonium chloride, di-(hydrogenated tallow) dimethyl ammonium chloride, dioctadecyl dimethyl ammonium chloride, dieicosyl dimethyl ammonium chloride, didocosyl dimethyl ammonium chloride, di-(hydrogenated tallow) dimethyl ammonium methyl sulfate, dihexadecyl dimethyl ammonium acetate, ditallow dipropyl ammonium phosphate, ditallow dimethyl ammonium nitrate, di-(coconut-alkyl)dimethyl ammonium chloride, cetyltrimethylammonium chloride, stearyltrimethylammonium chloride, distearyldimethylammonium chloride, lauryldimethylammonium chloride, and tricetylmethylammonium chloride, along with other quaternary compounds such as trihydroxyethylmethylammonium methosulfate, lauryldimethylbenzylammonium chloride, and the like. Many of these materials are available under the Varisoft® brand at Degussa such as Varisoft® DS 100 or Varisoft® DS 150. A particular preferred quaternary ammonium cationic surfactant is di-(hydrogenated tallow) dimethyl ammonium methyl sulfate.

Quaternary ammonium cationic surfactants of the formula (II) are known as ester quats. Ester quats are notable for excellent biodegradability. In the formula (II), $R^4$ represents an aliphatic alkyl radical of 12 to 22 carbon atoms which has 0, 1, 2 or 3 double bonds; $R^5$ represents H, OH or 0-(CO)$R^7$, $R^6$ represents H, OH or O(CO)$R^8$ independently of $R^5$, with $R^7$ and $R^8$ each being independently an aliphatic alkyl radical of 12 to 22 carbon atoms which has 0, 1, 2 or 3 double bonds, and m, n and p are each independently 1, 2 or 3. $X^-$ may be a halide, methyl sulfate, ethyl sulfate, methyl phosphate, nitrate, acetate or phosphate ion and also mixtures thereof. Useful are compounds wherein $R^5$ is 0-(CO)$R^7$ and $R^4$ and $R^7$ are alkyl radicals having 16 to 18 carbon atoms, particularly compounds wherein $R^6$ also represents OH. Examples of compounds of the formula (II) are methyl-N-(2-hydroxyethyl)-N,N-di-(tallow acyloxyethyl)ammonium methyl sulfate, bis-(palmitoyl)-ethylhydroxyethyl methyl ammonium methyl sulfate or methyl-N,N-bis(acyloxyethyl)-N-(2-hydroxyethyl)ammonium methyl sulfate. In quaternary surfactants of the formula (II) which comprise unsaturated alkyl chains, preference is given to acyl groups whose corresponding fatty acids have an iodine number between 5 and 80, preferably between 10 and 60 and especially between 15 and 45 and also a cis/trans isomer ratio (in % by weight) of greater than 30:70, preferably greater than 50:50 and especially greater than 70:30. Commercially available examples are the methylhydroxyalkyldialkoyloxyalkylammonium methyl sulfates marketed by Stepan under the Stepantex® brand or the Cognis products appearing under Dehyquart® or the Degussa products appearing under Adogen® and Rewoquat® brands. Most preferred is Adogen 66 from Degussa-Goldschmidt, which is ethylbis-(hydroxyethyl)-tallow alkyl, ethoxylated, Et-sulfate. Further ester quats of use in the present invention have the formulas; $[(CH_3)_2N^+(CH_2CH_2OC(O)—R)_2]X^-$ or $(HOCH_2CH_2)(CH_3)N^+(CH_2CH_2OC(O)—R)_2]X^-$, where R=linear saturated or unsaturated alkyl radical of 11 to 19 and preferably 13 to 17 carbon atoms. In a particularly preferred embodiment the fatty acid residues are tallow fatty acid residues. X-represents either a halide, for example chloride or bromide, methyl phosphate, ethyl phosphate, methyl sulfate, ethyl sulfate, acetate, nitrate, phosphate and also mixtures thereof.

Further useful acyclic quaternary ammonium cationic surfactant include the diester quats of the formula (III), obtainable under the name Rewoquat® W 222 LM or CR 3099, which provide stability and color protection as well as softness:

(III)

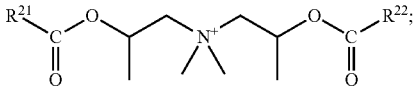

where $R^{21}$, and $R^{22}$ each independently represent an aliphatic radical of 12 to 22 carbon atoms which has 0, 1, 2 or 3 double bonds.

Another possible quaternary ammonium cationic surfactant is 1,2-Bis-[talgacyloxy]-3-trimethylammoniumpropanchlorid.

Beside the quaternary ammonium cationic surfactant the fabric conditioning composition comprises an additive selected form the group consisting of trialkyl glycerides, fatty acids and mixtures thereof. Preferably, the additive is at a level from 10% by weight to 45% by weight of the fabric conditioning composition and more preferred from 10% by weight to 40% by weight of the fabric conditioning composition. It has become evident that fabric conditioning compositions comprising the additive in an amount up to 45% by weight of the fabric conditioning composition show no spotting at all.

In a particularly preferred embodiment of the invention, the fabric conditioning composition comprises a mixture of trialkyl glycerides and fatty acids. It has been proven that the combination of these two additives is very beneficial for the adjustment of the melting point and/or the firmness of the fabric conditioning composition. Following from this, a laundry article comprising a fabric conditioning composition comprising a quaternary ammonium cationic surfactant, trialkyl glycerides and fatty acids shows good cleaning and conditioning properties without any or only little spotting.

It may be preferred that the fabric conditioning composition comprises both additives at almost the same level. Consequently, in such an embodiment it is preferred that the trialkyl glyceride is at a level from 5% by weight to 22.5% by weight of the fabric conditioning composition and more preferred from 10% by weight to 20% by weight of the fabric conditioning composition and that the fatty acid is at a level from 5% by weight to 22.5% by weight of the fabric conditioning composition and more preferred from 10% by weight to 20% by weight of the fabric conditioning composition.

But it may also be preferred that the fabric conditioning composition comprises both additives at different levels. In such an embodiment it may be preferred that the fabric conditioning composition comprises the fatty acid in a higher level than the trialkyl glyceride.

Trialkyl glycerides that may also be denoted as alkyl triglycerids are esters of saturated or unsaturated carbon acids and glycerol. It is preferred that the trialkyl glyceride comprises $C_5$-$C_{22}$ triglycerides. Suitable trialkyl glycerides include glycerides based on caproic acid, caprylic acid, capric acid, myristic acid, palmitic acid, stearic acid, oleic acid, linolenic acid and linoleic acid. Combinations of more than one trialkyl glyceride may also be desired in the fabric conditioning composition in order to adjust the melting point and/or the firmness of the fabric conditioning composition. It is preferred that the trialkyl glyceride is an unsaturated triglyceride. It may be advantages that the trialkyl glyceride comprises the triesters of tallow fatty acid and glycerol.

A fatty acid is another possible ingredient of the fabric conditioning composition. The fatty acid may be selected from saturated and unsaturated fatty acids as well as natural fatty acids. The fatty acid serves to adjust the melting point and/or the firmness of the fabric conditioning composition. Additionally, the presence of the fatty acid improves the delivery of fragrance, if present.

Suitable fatty acids include caprylic acid, capric acid, lauric acid, myristic acid, palmitic acid, stearic acid, (hydrogenated) erucaic acid, linoleic acid, linolenic acid, oleic acid, (hydrogenated) behenic acid, coconut fatty acid, palm kernel fatty acid, olive oil fatty acid, or tallow fatty acid. Combinations of more than one fatty acid may also be desired in the fabric conditioning composition.

In a preferred embodiment, the fabric conditioning composition contains a fragrance in an amount of usually up to 20% by weight, preferably 1% to 15% by weight, in particular 2% to 10% by weight of the fabric conditioning composition.

Individual fragrance compounds may be used as fragrance oils and/or scents, e.g., the synthetic products of the type of esters, ethers, aldehydes, ketones, alcohols and hydrocarbons. However, mixtures of different perfumes which jointly produce an appealing scent note are preferred. Such fragrance oils may also contain natural fragrance mixtures, such as those accessible from plant sources.

It is possible that the fabric conditioning composition additionally comprises certain amounts of an organic solvent such as ethanol or isopropanol. These organic solvents may originate from the quaternary ammonium cationic surfactant raw material. It is preferred that the amount of organic solvents is below 10% by weight of the fabric conditioning composition.

Besides the fragrance the fabric conditioning composition may comprise other optional ingredients such as fragrance vehicles, fluorescent agents, dyestuffs, foam inhibitors, silicone oils, anti-redeposition agents, graying inhibitors, shrinkage preventers, antiwrinkle agents, dye transfer inhibitors, antimicrobial active ingredients, germicides, fungicides, antioxidants, corrosion inhibitors, antistatics, ironing aids, phobizing and impregnating agents, swelling and nonslip agents, and UV absorbers. If the fabric conditioning composition is basically a fabric softening composition a preferred optional ingredient of the fabric conditioning composition is an antistatic agent. Another preferred optional ingredient of a fabric conditioning composition is an antimicrobial active agent such as silver or a silver compound such as SILVERPLUS® (available from Rudolf Chemie).

It is preferred that the fabric conditioning composition has a melting point of ≥50° C. and more preferred in the range of 50 to 58° C. in order to avoid spotting.

The detergent composition applied to the substrate may comprise anionic surfactant, nonionic surfactant, builder, chelant and further adjuvant ingredients such as but not limited to bleaches, bleach catalysts, bleach activators, enzymes, fragrances, fragrance vehicles, fluorescent agents, dyestuffs, foam inhibitors, silicone oils, anti-redeposition agents, graying inhibitors, shrinkage preventers, antiwrinkle agents, dye transfer inhibitors, antimicrobial active ingredients, germicides, fungicides, antioxidants, preservatives, corrosion inhibitors, antistatics, and UV absorbers and is preferably a co-melt of mostly anhydrous waxy ingredients (materials normally solids or waxes at ambient temperature), or low-water content slurry or paste. The detergent composition even if a co-melt of waxy ingredients may preferably contain insoluble particles agglomerated into the melt, either for performance or aesthetic reasons.

A preferred optional ingredient that can be comprised in the fabric conditioning composition and/or in the detergent composition is a detergency booster such as an $C_{12-18}$ alkyl dimethyl hydroxyethyl ammoniumchloride such as Praepagen® HY (available from Clariant).

A variety of materials may be used as the substrate in the present invention. For example the substrate may be natural pulp based paper or cotton materials, entirely synthetic material (such as melt-blow, spun-laid, air-laid or carded/bonded polypropylene, polyester, or similar synthetic polymer fiber substrates) or combinations of natural and synthetic materials (such as pulp wet-laid onto a nonwoven web). For example, any of the substrates used in the "wet-wipes" hard surface and personal cleansing products, dryer sheets, or personal hygiene products currently on the market may be useful as the substrates for the articles of the present invention. Additionally, materials that are found in liquid and air filtration industries may find use as the substrate.

Suitable substrate sheets may be obtained from any number of various water-insoluble nonwoven fabrics. The term "sheet" is used somewhat loosely here and relates to a preferred shape of an individual article of the present invention, that is, a flat sheet, for example square or rectangular, that is much greater in width and length than thickness and is a single laundry article. Thus the term "sheet" is used as a description of a section of nonwoven that may be used for an individual article of the present invention.

Nonwoven fabrics with their multitude of uses are well known to those skilled in the textiles art. Such fabrics can be prepared by forming a web of continuous filament and/or staple fibers and optionally bonding the fibers at fiber-to-fiber contact points to provide fabrics of the required properties. The term "bonded nonwoven fabric" is used to include nonwoven fabrics where a major portion of the fiber-to-fiber bonding is achieved by either thermal fusion of adjacent fibers, or adhesive bonding that is accomplished through incorporation of adhesives in the web to "glue" fibers together, or by other bonding such as obtained by the use of liquid or gaseous bonding agents (usually in conjunction with heating) to render the fibers cohesive. Chemical bonding may be accomplished through the use of adhesive or latex powders dispersed between the fibers in the web, which is then activated by heat, ultraviolet or infrared radiation, or other suitable activation method. Thermally and/or chemically bonded nonwovens may be used as the substrates within the present invention.

Nonwovens may comprise fibers known as "bi-component fibers", for example "sheath/core bi-component fibers", which are fibers having an outer sheath area or layer with a lower melting point than the inner core area, allowing for efficient and controlled thermal bonding through melting of just the outer layer of each fiber. Additionally, multi-component fibers are similarly known and commercially incorporated into nonwovens.

During the bonding of the fibers, the web may be simultaneously subjected to mechanical compression to obtain the desired bonding, weights and thicknesses in a process known as "thermal compression bonding". Thermal compression bonding may be accomplished by using apparatuses such as a hot embossing roll and a heat flat calendar roll, and incorporating a method in which a heat treating machine such as a hot blast-circulating type, a hot through-air type, an infrared heater type or a vertical hot blast-blowing type is used to carry out thermal compression bonding. Mechanical compression may be used to set the loft or thickness of fabrics with similar basis weights. Normally increasing the basis weight, or the mass per square area increases thickness, and increasing bonding and compression decreases loft. Nonwovens with "sidedness" are preferred for use in the articles of this invention. Sidedness refers to a nonwoven with a difference in density and/or loft on each side. These preferred nonwovens with sidedness may also be described by looking at the internal cross section through the nonwoven. For example, the preferred nonwovens for use herein have at least one "non-uniform cross-section". That is, if the preferred nonwoven with sidedness is cut, the exposed edge will be seen to be inhomogeneous, or in other words, having a gradient of fiber densities from one side through to the opposite side of the nonwoven. Single or multiple passes of mechanical compression while bonding may be used to produce nonwoven fabric that has sidedness, for example by differing the heating for thermal bonding on each side, along with using differing fibers diameters for each side, and/or by thermal compression bonding a nonwoven that was carded with different groups of fiber types on each side. Sidedness can also be accomplished by using different fiber thicknesses brought together in layers that look much like a laminating process, and allowing the heat/powder adhesive for thermal or powder/thermal bonding to bond the thinner more closely webbed fibers more densely and the thicker less closely webbed fibers lighter and loftier Laminated as a term used herein should be construed to mean fiber webs that were separately carded brought together to form a single nonwoven. The term laminated should not be construed to mean the gluing to together of layers of material such as gluing or otherwise bonding together a polyurethane scrubbing layer onto a cellulose sponge. Although nonwovens may be constructed by laminating together two or more carded webs of fibers, the net result is a thicker nonwoven wherein it is difficult to discern layers. Depending on how a multi-layered nonwoven is finished (for example, the degree of thermal or chemical/thermal bonding of the fibers), the net resulting laminated nonwoven may appear to be a single layer of fibers. But when looking at a cross section of such a preferred nonwoven, the gradient of density may be visible, even without discerning a discrete transition between the original carded webs.

Nonwoven webs have been formed from many processes, for example, melt-blown, spun-bonded or spun-laid, toe-opened, wet-laid, air-laid, carded, and high pressure hydro-entangled. A preferred nonwoven for use as the substrate for the articles of the present invention are carded thermal bonded, or carded powder/thermal bonded nonwovens, for example, those available from HDK Industries, Inc.

These most preferred substrates have a "non-uniform cross-section" at least somewhere along the nonwoven. For example, the nonwoven may be uniform across its length and width (for example, viewing the top or the bottom surfaces of the substrate), yet still have non-uniform cross-section through its thickness (i.e., when viewing the edge of the substrate either as made or when cut through a cross-section). Additionally, nonwovens may be layered and in ways where the top layer does not fully cover the bottom layer and an asymmetrical fabric is produced that has part of its width as a single density fabric and an adjacent part of its width as a gradient of fiber densities. These nonwovens have a non-uniform cross-section somewhere on the fabric. For example, to see the non-uniform cross section one would have to cut the fabric in the area where there are two layers (and a gradient of density through the fabric thickness) rather than cutting through the single layer portion where there is uniform density of fibers through the thickness of the substrate. Any of these fibers used in the substrates may be single component polymers, bi-component (sheath/core) or multi-component in order to get the desired level of fiber bonding in a thermal bonding operation.

Examples of nonwovens that may find use as the water-insoluble substrates to the articles of the present invention may include, but are not limited to, Ahlstrom Needlepunch, Ahlstrom 11 B04.31 10, Ahlstrom VPM7.1, Sandler Sawaloom® 6000, Sandler Sawaloom® 6600, Sandler Sawaloom® 6700, Sandler Sawaloom® 6351, Sandler Sawaloom® 2621 and Sandler Sawatex® 2611 (spunlace products), all from Sandler AG; Texel® 04531 needlepunch, and Texel® 05232 needlepunch from Tenotex; and HDK #225 thermal bonded PET, and HDK #590, 401, 330, #2, #4 and #5 thermal bonded nonwovens from HDK Industries, Inc. The more preferred substrates include polyester nonwovens comprised of at least two fiber deniers (thus having non-uniform cross section or a fiber density gradient through the thickness of the nonwoven), which are processed or layered in a method that produces a flatter more dense side and a lighter lofty side, and these include but not limited to the following materials available from HDK Industries, Inc.; a Flat/Lofty nonwoven comprised of 2½ and 4 denier fibers and 4 and 6 denier polyester and polyester bi-component fibers, 2-pass, layered, 4.2 osy and about 2.5 mm thick; a Flat/Lofty nonwoven comprised of 2½ and 4 denier fibers and 4 and 6 denier polyester and polyester bi-component fibers, I-pass, carded, layered, 4.2 osy and about 3.5 nun thick; Flat/Lofty nonwoven comprised of 2½ and 4 denier and 4 and 6 denier polyester and polyester bi-component fibers, I-pass, carded, layered, 3.5 osy and about 2.7 mm thick; and, Flat/Lofty nonwoven comprised of 2½ and 4 denier and 4, 6 and 15 denier polyester and polyester bi-component fibers, I-pass, carded, layered, 4.2 osy and about 3.3 mm thick.

The basis weight of non-woven webs is usually expressed in ounces of material per square yard (osy) (1 ounce=28.35 grams; 1 yard=0.91 m) or grams per square meter (gsm) and the fiber diameters are usually expressed in micrometers, or in the case of staple fibers, "denier". "Denier" is defined as grams per 9000 meters of fiber length.

The fibers may be carded in layers, with the end result a gradient of fiber density and a gradient of fiber deniers. These preferred nonwovens have a non-uniform cross-section rather than visible layers such as for example a scrubbing sponge with cellulose and scrubbing layers. As described in more detail below, the combination of flat and lofty sides in the substrate greatly aids the loading and the subsequent release of the softener composition from the substrate. Not being bound by any theory, it appears that the softener feeds out from the flat side of the nonwoven substrate while in the heated clothes dryer, perhaps through wicking along a gradient of fiber deniers even though it was applied and solidified on the lofted side of the nonwoven. The delivery of softener through the flat side was shown by folding substrates in half, stapling them together with either the flat side hidden inside or exposed to the outside, and running them through the wash/dry cycles.

Additionally, it may be preferred that the substrate comprises an antimicrobial active agent such as silver or a silver compound such as SILVERPLUS® (available from Rudolf Chemie).

The dimensions of the sheet cut for the substrate in the article of the present invention should be suitable for easy handling, for example in the range of from about 10 cm×10 cm to about 20 cm×20 cm, however sheets of other dimensions may be useful when organized in convenient packaging for the consumer. Of course the sheet does not need to be square or really any particular shape, and any shape such as rectangular, polyhedral, rhomboidal, round, oval, heart- or other decorative-shape, even shaped in a way to identify a particular brand (such as the shape of a letter or word or trademark), will work within the present invention. The substrate for use in the present invention may be colored in any color (vivid colors for example), or may be substantially white, and may be textured from heated rollers that are patterned. The sheets may be rolled up or folded or otherwise intricately compacted in order to fit some unique packaging designs, or may be simply stacked like stiff cards into a suitable carton for merchandising. Also, the aesthetics of the sheet should be pleasing enough so that consumers will want to use it with their laundry chores. Thus, each of the separate composition zones should be individually recognizable to the consumer, for example through color, transparency, gloss, texture, fragrance, or any combinations of these attributes. For example, a sheet within the present invention may have a deep blue detergent zone and an opaque pink softener/anti-static zone (knowing that these are consumer recognizable as traditional detergent and fabric conditioning colors), or perhaps a detergent region that has colored particles embedded within the zone.

It is preferred that in an article comprising at least two composition zones that the fabric conditioning composition zone geographically covers 2-30% of the total surface area of the article while the detergent composition zone covers 70-98% of the total surface area of the article. It may also be preferred that the surface of the article is not completely covered with composition-containing zones.

It is preferred that the detergent composition zone is completely soluble in water while the fabric conditioning composition zone is more than 80% retained (stable) through a standard wash cycle.

The water-insoluble substrate for the laundry article of the present invention may be impregnated with a detergent composition and a fabric conditioning composition through any suitable processing step, for example a simple spray coating of the nonwoven substrate with a heated molten mixture or an aqueous solution to even dipping of the nonwoven substrate into various mixtures. For example, the molten compositions may be sputter-sprayed from guns with heated nozzles much in the same way that heavy paints, glues and coatings and the like are sprayed onto wide surfaces in many other industries. The impregnation of each composition on the substrate may be conducted either at the same time (in a simultaneous process with parallel feeders or sprayers for example) or in separate operations that are perhaps sequential operations of the same process or separate combinations of different processes. Impregnations may be applied on one side of the substrate, or one or more impregnations (for example the detergent formulation) can be applied on one side, and the other composition (for example the fabric conditioning formulation) may be applied on the other side of the substrate. This is a particularly important option for when a substrate having dissimilar sides is used. A suitable process for impregnation is for example a slot-coating process or a Gravure-coating process. In a slot coating process, the fluid to be coated is forced under pressure through a thin slot of a given width and length. The mass rate of application (gm/second) is controlled by both application pressure and slot size. The nonwoven substrate is coated as it is drawn past the slot (for example at 1-100 feet per minute). Depending upon the scale of manufacture, representative slot-coating dies include Ultracoat, Acuflow, Ultra flow product from Extrusion Dies Industries LLC (EDI), Wayne Yellow Jacket® Flexible Lip Flat Dies, or Liberty Die Coating Equipment. The form of any of the compositions applied to the substrate may be anything from thin to thick liquid, to slurry or paste, to molten materials that solidify into waxy appearing coatings upon cooling. It is simpler and preferable to apply both the detergent compositions and the fabric conditioning compositions as molten mixtures, even though the detergent compositions may be applied as aqueous solutions or slurries in a spray or dipping operation with a subsequent drying step to remove the excess water from the substrate. It should be understood that the scope of the present invention includes the application of any of the described compositions in stages to the substrate. For example, in the application of a detergent composition to the substrate, one or more of the ingredients may be left out of the composition and applied separately to the nonwoven (for example, to pre-condition the substrate). Then the remaining ingredients comprising the detergent composition are applied to the substrate. Additionally it is within the scope of the present invention to separate out a "third zone" on the substrate. For example, it may be desirable to have a detergent zone, a fabric conditioning zone and a third, separate fabric treatment zone, such as a water-soluble builder or water condition, an extra surfactant or detergent booster, or a separate fragrance boost zone for the washer or dryer, and so forth. The invention is not restricted to just a detergent zone and a fabric conditioning zone. Special products for separate market needs may be produced that have any number of zoned compositions or ingredients as suits the market/consumer needs.

Specific, but non-limiting embodiments of the laundry article of the present invention are delineated in the tables below.

Table 1 shows combinations of the detergent ingredients described above to produce detergent compositions suitable for application to the substrate.

The compositions D1 to D5 listed in Table 1 are heated co-melts and the amounts (amounts of actives in weight percent (wt. %)) shown are also the amounts on the substrate since any water in the composition tends to stay within the waxy zone.

TABLE 1

Example detergent compositions for application to a substrate

| Ingredients | Weight Percent (actives %) D1 | D2 | D3 | D4 | D5 |
|---|---|---|---|---|---|
| Sodium dodecyl benzene sulfonate | 26.09 | 17.30 | 15.60 | 17.70 | 16.70 |
| Sodium alkyl $C_{14}$-$C_{15}$/7EO ether sulfate | 13.80 | — | — | — | — |
| Linear alcohol ethoxylate $C_{14}$-$C_{15}$/7E0 | 13.44 | 5.40 | 14.60 | 5.50 | 5.20 |
| Polyethylene Glycol PEG-75 | 2.00 | 1.40 | 1.30 | 1.40 | 1.40 |
| Polyoxyethylene (100) stearyl ether | 21.99 | 15.60 | 14.10 | 15.90 | 15.10 |
| Sodium Silicate $SiO_2/Na_2O$ ratio 1.6-1.8 | 3.72 | 16.60 | 15.00 | 17.00 | 16.00 |
| Sodium Silicate (Britesil ® C24) | 7.00 | — | — | — | — |
| Sodium Carbonate | — | 6.50 | 5.90 | 6.70 | 6.30 |
| Sodium tetraborate decahydrate | — | 11.90 | 10.80 | 12.20 | 11.50 |
| Sodium polyacrylate ~4,500 MW | — | 1.80 | 1.70 | — | 5.20 |
| EDTA -tetrasodium salt | — | 0.10 | 0.10 | 0.10 | 0.10 |
| Optical brightener (Tinopal ® CBS-X) | 0.15 | 0.10 | 0.09 | 0.10 | 0.10 |
| Dyes and fragrances | 0.90 | 0.90 | 0.81 | 1.01 | 0.91 |
| Water | 10.92 | 22.10 | 19.90 | 22.40 | 21.50 |

Table 2 shows combinations of the ingredients described above to produce fabric conditioning compositions suitable for application to the substrates.

TABLE 2

Example fabric conditioning compositions for application to a substrate

| Ingredients | Weight Percent (actives %) FS 1 | FS2 | FS3 | FS4 | FS5 | FS6 |
|---|---|---|---|---|---|---|
| Di-(hydrogenated tallow) dimethyl ammonium methyl sulfate | 65.8 | 68.4 | 72.0 | 64.8 | 56.7 | 81 |
| Unsaturated trialkylglycerides | 12.15 | 9.5 | 6.75 | — | 12.15 | — |
| Hydrogenated tallow fatty acid | 12.15 | 9.4 | 6.75 | — | 12.15 | — |
| Fatty acid* | — | — | — | 18 | 9 | — |
| Fragrance oil | 10 | 10 | 10 | 10 | 10 | 10 |
| Isopropanol | 0.9 | 2.7 | 4.5 | 7.2 | — | 9 |
| Melting point (° C.) | 50 | 50/57 | 56 | 52.5 | 50 | 65 |

*50:50 mixture of palmitic acid and stearic acid

TABLE 3

Laundry Article Examples

| | Weight composition (g) of compositions loaded on the particular substrate indicated A | B | C | D | E | F |
|---|---|---|---|---|---|---|
| Detergent composition | 2 (8 G) | 2 (8 G) | 2 (8 G) | 2 (8 G) | 2 (8 G) | 2 (8 G) |
| Fabric conditioning composition | FS1 (1.34 G) | FS2 (1.34 G) | FS3 (1.34 G) | FS4 (1.34 G) | FS5 (1.34 G) | FS6 (1.34 G) |
| Nonwoven* | PES | PES | PES | PES | PES | PES |

*non-woven polyester fiber from HDK Industries

Laundry articles A to E are within the scope of the invention whereas laundry article F constitutes a comparative example.

Laundry articles A to C, E and F were subjected to standard wash cycle using a toploader washing machine being loaded with 3.5 kg of fabrics comprised of different materials (polyester, polyester/cotton, polyamide/elasthane, polyamide/Micro Modal/elasthane, viscose). Subsequently, the complete content of the washing machine was transferred to a dryer (Kenmore model no. 417) and subjected to a drying cycle (duration: 50 minutes; program: auto dry; temperature range: medium temperature 40-75° C., high temperature: 40-100° C.).

TABLE 4

Results

| | Amounts (g) of fabric conditioning composition remaining on the substrate after a washing and a drying cycle A | B | C | E | F |
|---|---|---|---|---|---|
| Before washing | 1.34 | 1.34 | 1.34 | 1.34 | 1.34 |
| After washing | 1.16 | 1.19 | 0.53 | 1.19 | 0.4 |
| Remaining on substrate in % | 87 | 89 | 40 | 88 | 30 |
| After tumbling | 0.13 | 0.45 | 0.25 | 0.3 | 0.15 |
| Remaining on substrate in % | 11 | 38 | 47 | 22 | 38 |

The dried fabrics were investigated with respect to spotting: Laundry articles A, B, C and E showed no spotting, whereas laundry article F showed little spotting. Additionally, cloths treated with laundry article F only showed little softening effect and only small fragrance intensity.

Altogether, laundry articles A to E showed good cleaning, softening and fragrance delivery properties to fabrics treated therewith.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A laundry article used for both cleaning and conditioning fabrics comprising:

a. a water-insoluble nonwoven substrate, said substrate having a non-uniform cross section wherein the cross section has a gradient of fiber density;

b. a detergent composition solidified on the substrate in at least one zone; and, c. a fabric conditioning composition solidified on the substrate in at least one zone, wherein the fabric conditioning composition comprises a quaternary ammonium cationic surfactant at a level from 55% by weight to 90% by weight of the fabric conditioning composition and an additive wherein the additive comprises a mixture of $C_5$-$C_{22}$ alkyl triglycerides and fatty acids at a level from 10% by weight to 45% by weight of the fabric conditioning composition.

2. The article of claim 1, wherein the alkyl triglyceride is at a level from 10% by weight to 40% by weight of the fabric conditioning composition.

3. The article of claim 1, wherein the fatty acid is at a level from 10% by weight to 40% by weight of the fabric conditioning composition.

4. The article of claim 1 wherein the fabric conditioning composition additionally comprises a fragrance.

5. The article of claim 1 wherein the alkyl triglyceride is selected from saturated or unsaturated C5-C22-alkyl triglycerides.

6. The article claim 1 wherein the fatty acid is selected from caprylic acid, capric acid, lauric acid, myristic acid, palmitic acid, stearic acid, (hydrogenated) erucaic acid, linoleic acid, linolenic acid, oleic acid, (hydrogenated) behenic acid, coconut fatty acid, palm kernel fatty acid, olive oil fatty acid, and (hydrogenated) tallow fatty acid.

7. A method of washing and conditioning fabrics comprising the steps of:

a. supplying the laundry article of claim 1;

b. washing a load of fabrics in a laundry machine with said article;

c. removing the washed fabrics from said laundry machine along with said article;

d. transferring the fabrics into the dryer along with said article; and, e. drying said fabrics in the dryer along with said article.

* * * * *